United States Patent [19]

Greenberg et al.

[11] 4,098,074

[45] Jul. 4, 1978

[54] COMBUSTOR DIFFUSER FOR TURBINE TYPE POWER PLANT AND CONSTRUCTION THEREOF

[75] Inventors: Paul B. Greenberg, Manchester; Robert P. Lohmann, South Windsor; Philip M. Wing, East Hartford, all of Conn.

[73] Assignee: United Technologies Corporation, Hartford, Conn.

[21] Appl. No.: 691,813

[22] Filed: Jun. 1, 1976

[51] Int. Cl.[2] ..... F02C 7/22

[52] U.S. Cl. ..... 60/39.36; 60/39.65; 60/39.74 R

[58] Field of Search ..... 60/39.65, 39.74 R, 39.74 B, 60/39.36; 415/207, 211, 213 C

[56] References Cited

U.S. PATENT DOCUMENTS

| | | | |
|---|---|---|---|
| 2,720,080 | 10/1955 | Oulianoff et al. | 60/39.65 |
| 3,034,297 | 5/1962 | Orchards et al. | 60/39.65 |
| 3,589,127 | 6/1971 | Kenworthy et al. | 60/39.65 |
| 3,631,674 | 1/1972 | Taylor | 60/39.65 |
| 3,750,397 | 8/1973 | Cohen et al. | 60/39.65 |
| 3,811,277 | 5/1974 | Markowski | 60/39.65 |
| 3,877,221 | 4/1975 | Lefebvre et al. | 60/39.65 |

*Primary Examiner*—Robert E. Garrett
*Attorney, Agent, or Firm*—Norman Friedland

[57] ABSTRACT

This invention is for a turbine type power plant which includes a swirl-type annular burner and is concerned with diverting a portion of compressor air from the compressor discharge flow stream where it is utilized for cooling and dilution in the burner and is particularly concerned with the construction of the diffuser section.

7 Claims, 2 Drawing Figures

COMBUSTOR DIFFUSER FOR TURBINE TYPE POWER PLANT AND CONSTRUCTION THEREOF

BACKGROUND OF THE INVENTION

This invention relates to turbine type of power plants and particularly to the combustor diffuser associated with an annular swirl-type burner.

As is well known, it is conventional to bleed a portion of the compressor discharge air and utilize it in the combustor for purposes other than combustion, namely, cooling and dilution. The air to the outer shroud of an annular combustor is bled off by some form of splitter and its velocity is reduced with minimum pressure losses by a suitable diffuser. As is generally well known it has been the practice to straighten the swirling flow leaving the compressor rotor by use of straightening vanes prior to its being diffused. Even in the annular swirl burner, in which a swirl component of velocity is retained at the compressor exit to enhance the mixing and combustion processes to the combustor proper, it has been necessary to straighten this swirling flow at the entrance to the outer shroud to obtain efficient diffusion in this passage. Thus, in certain installations, this portion of the combustor, that is the outer shroud, not only included the diffuser and anti-swirl vanes, but for structural reasons it also included support struts.

We have found that we can improve on the design of the splitter, diffuser and the overall annular swirl combustor to obtain a reduced combustor length with an attendant engine weight reduction and eliminating or minimizing the shaft critical speed problem as well as attaining an improvement in the assembly and manufacturing thereof. To this end the passage to the diffuser is located to take advantage of the ability of the swirling flow to negotiate a radially outward turn of approximately 45° without incurring substantial losses. The support struts are canted with respect to the passage center line to receive the airflow at a predetermined incidence so as to create a quasi-pipe diffuser within the passages between struts without the need to straighten the flow. Additionally, the struts are made thicker than heretofore to provide the structural integrity, thus requiring an increased annular passage height to maintain a given flow area. Because of the increased height, radial tolerances have less influence on accuracy of the flow area. This also serves to simplify manufacturing especially if investment casting is used. By virtue of this invention in a particular embodiment, we were able to eliminate over 100 straightening vanes in the outer diameter passage, which not only simplify the assembly, manufacturing, but also resulted in a considerable cost savings.

SUMMARY OF THE INVENTION

An object of this invention is to provide an improved annular swirl combustor for a turbine type power plant.

A still further object of this invention is to provide for an annular combustor a slanted diffuser characterized by its ability to collect a portion of a stream of swirling air in an effective manner so as to reduce combustor length.

A still further object of this invention is to cant the support struts in the diffuser passage with respect to the passage center line so its angle agrees with the swirl angle of the airflow thereby creating efficient diffusing passages between these struts and eliminating the need of straightening vanes.

A still further object of this invention is to increase the thickness of the struts so that height of the annular passage of the outer diffuser of an annular swirl combustor is increased for a given flow to simplify the assembly and manufacturing thereof and reduce its expense.

Other features and advantages will be apparent from the specification and claims and from the accompanying drawings which illustrate an embodiment of the invention.

DESCRIPTION OF THE PREFERRED EMBODIMENT

Figures 1, 2:
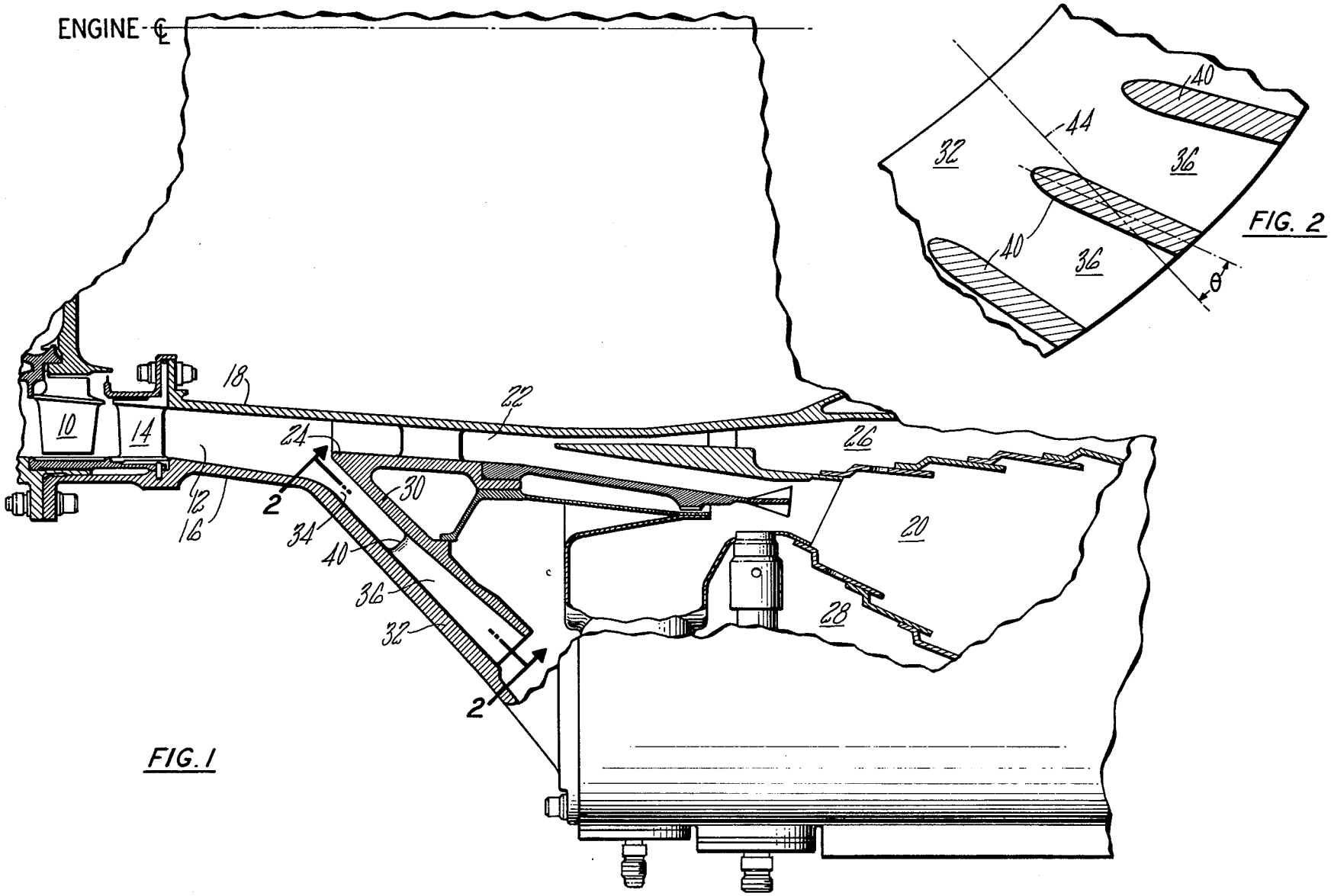
FIG. 1 is a partial view of an annular swirl combustor for a turbine type power plant partly in section and partly in elevation showing the details of this invention.
FIG. 2 is a partial sectional view taken along the lines 2—2 of FIG. 1.

As best shown, flow from the axial flow compressor discharges from the last row of blades 10 (one partially shown) into annular passage 12 via vanes 14. The flow discharging from the vanes has a swirl component of velocity. Passage 12 is formed from the outer wall 16 and the inner wall 18, it being appreciated that these distances are with respect to the engine center line. The compressor discharge air is routed to the annular burner 20 via the passage 22 which is formed from the extension of wall 18 and the splitter 24. This part of the annular burner is well known and does not form part of this invention so that for the sake of convenience and simplicity a detailed description thereof is omitted. Suffice it to say that a portion of compressor discharge air supports combustion in burner 20 and an additional portion is fed into the inner shroud 26 for cooling purposes. Air discharging from the combustion drives the turbine mounted immediately downstream thereof. For further details of swirl burning reference is made to U.S. Pat. Nos. 3,701,255; 3,872,664 and 3,675,419 incorporated herein by reference.

In accordance with this invention, a still additional portion of the air in passage 12 is bled to the outer shroud 28 where it surrounds the outer burner liner and is used for cooling purposes. The splitter wall 30 and diffuser outer wall 32 define a passage for leading the bled air to the diffuser passage 36. The angle of the passage 34 with respect to passage 12 is selected to effectively bleed the compressor discharge air. Because the centrifugal force on the swirling air tends to force it to flow radially outward the inclination of the passage relative to passage 12 may be higher. We have found, through experiment that this angle may be as high as 45° without compromising the pressure recovery characteristics. Because of the high inclination of passage 36 the combustor length can be reduced substantially resulting in a savings in engine weight and a shortening of the engine shaft, thus reducing its critical speed problems.

Struts 40 are spaced circumferentially in annular diffuser passage 36 and support this assembly and may be integral with either wall 30 or 32. As best seen in FIG. 2 the forward end of each strut is contoured for aerodynamic reasons and are canted with respect to center line 44. This angle is selected to agree with airflow swirl angle so that it effectively creates a quasi-pipe diffuser which exhibits low pressure losses. Actual test show that the pressure rise characteristics of this type of diffuser which does not straighten the flow is equal to or better than a diffuser where straightening vanes are used to straighten the flow. In this instance flow discharging from diffuser passage 36 retains some of its swirl velocity components.

Struts 40 are made thicker as compared to heretofore used struts, which is possible in view of the elimination of the straightening vanes thus permitting passages 34 and 36 to be higher so as to accommodate the same volume flow. With the greater height, radial tolerances have less influence on accuracy of the flow area and also simplifies the manufacturing of the component parts. This is even more perceived when investment casting parts are used.

It should be understood that the invention is not limited to the particular embodiments shown and described herein, but that various changes and modifications may be made without departing from the spirit or scope of this novel concept as defined by the following claims.

We claim:

1. For a turbine type power plant having a compressor and a burner section, said burner section including an annular combustor and an outer shroud forming a chamber adjacent the combustor providing cooling air, a first passage leading to said compressor a diffuser passage bleeding air from the first passage feeding air at a reduced velocity to said chamber, said diffuser passage having a center line that is disposed substantially at a 45° angle relative to the first passage, said diffuser including elongated support struts circumferentially disposed therein defining with said diffuser passage open ended passageways, said struts being canted with respect to said center line so as to be oriented a predetermined angle with respect to the swirl component of velocity of the swirling air passing through said passageways, whereby the air discharging from said passageways retains its swirl component of velocity.

2. For a turbine type power plant as in claim 1 wherein the amount said struts are canted are such that it agrees with the swirl angle flowing into said passageways while maximizing the pressure recovery.

3. For a turbine type power plant as in claim 1 wherein said compressor is of the axial flow type.

4. In combination, a turbine power plant having an annular burner and compressor, an annular flow passage extending axially in said power plant parallel to the power plant's axis interconnecting said compressor and said burner, a splitter having a v-shaped portion in cross section having one leg of said v defining a wall portion for said annular flow passage wall means and the other leg of said v defining another annular flow passage angularly disposed with respect to said annular flow passage, the center lines of said annular flow passage and said other annular flow passage being substantially at a 45° angle with respect to each other, a shroud surrounding said burner and defining therewith a chamber for receiving a portion of said compressor discharge air from said other annular flow passage, diffuser means in said other annular flow passage, and circumferentially spaced strut means supporting said splitter in said diffuser means having an elongated body extending between said wall means and said other leg and defining open-ended passageways whose axial axis is canted relative to the axis of said other annular flow passage.

5. In combination as in claim 4 wherein said diffuser is on the downstream end of said other annular flow passage.

6. In combination as in claim 4 wherein said compressor includes axial flow compressor blades imparting a swirl component of velocity to the air stream flowing through said annular flow passage, said struts defining passageways having an axis oriented to coincide with the swirl angle of the flow passing through said passageway.

7. In combination as in claim 4 wherein said struts are relatively wide in the transverse plane and the distance between said wall means and said other leg means defining said diffuser means characterized by being relatively far, defining a relatively deep diffuser means.

* * * * *

UNITED STATES PATENT AND TRADEMARK OFFICE

CERTIFICATE OF CORRECTION

PATENT NO. : 4,098,074

DATED : July 4, 1978

INVENTOR(S) : Paul B. Greenberg, Robert P. Lohmann, Philip M. Wing

It is certified that error appears in the above-identified patent and that said Letters Patent are hereby corrected as shown below:

Column 1, insert the following paragraph before the "BACKGROUND OF THE INVENTION":

--The Government has rights in this invention pursuant to Contract No. F33657-72-C-0209 awarded by the Department of the Air Force.--

Column 3, line 26, "compressor" should read --combustor--

Column 3, line 27, after "passage" (second occurrence) insert --and--

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*